US006397639B2

(12) United States Patent
Haltenhof et al.

(10) Patent No.: US 6,397,639 B2
(45) Date of Patent: Jun. 4, 2002

(54) METHOD OF PRODUCING KNITTED ARTICLES WITH SEVERAL KNITTING PLANES

(75) Inventors: Hans-Guenther Haltenhof, Pfulligen; Henning Schmidt, Reutlingen, both of (DE)

(73) Assignee: H. Stoll GmbH & Co., Reutlingen (DE)

( * ) Notice: Subject to any disclaimer, the term of this patent is extended or adjusted under 35 U.S.C. 154(b) by 0 days.

(21) Appl. No.: 09/838,419

(22) Filed: Apr. 19, 2001

(30) Foreign Application Priority Data

Apr. 22, 2000 (DE) ..... 100 19 987

(51) Int. Cl.[7] ..... D04B 7/04
(52) U.S. Cl. ..... 66/64
(58) Field of Search ..... 66/60 R, 64, 62, 66/69, 75.1, 176

(56) References Cited

U.S. PATENT DOCUMENTS 5,584,197 A * 12/1996 Okuno ..... 66/64
6,065,311 A * 5/2000 Essig et al. ..... 66/64
6,119,487 A * 9/2000 Okuno ..... 66/64
6,138,482 A * 10/2000 Shima et al. ..... 66/64

* cited by examiner

*Primary Examiner*—Danny Worrell
(74) *Attorney, Agent, or Firm*—Michael J. Striker

(57) ABSTRACT

For producing knitted products with several knitting planes on a two bed flat knitting machine, all needles of one needle bed are usable for producing of stitches for a knitting plane, and the production of additional knitting plane is performed so that the stitches of another plane are transferred to the transfer element and held there, until new stitches for the knitting plane must be formed.

8 Claims, 23 Drawing Sheets

Fig. 5.0
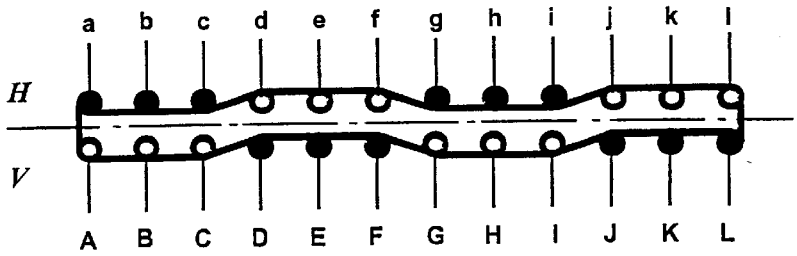
Fig. 5.1
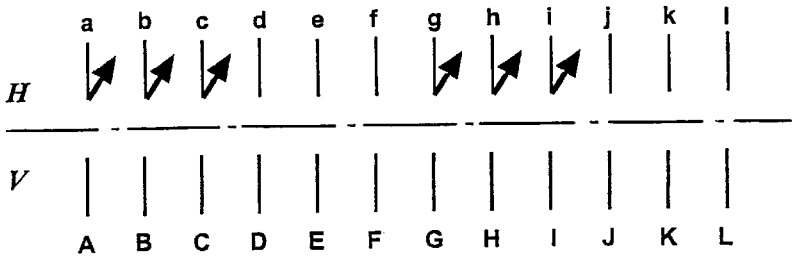
Fig. 5.2
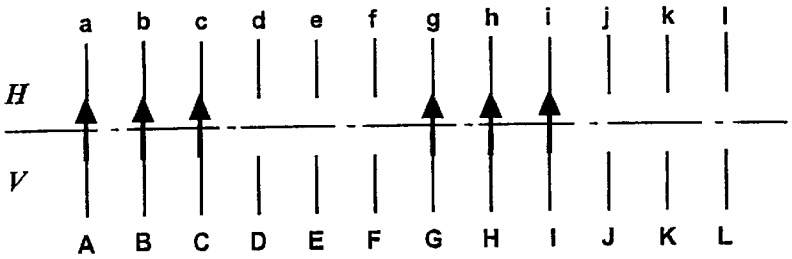
Fig. 5.3
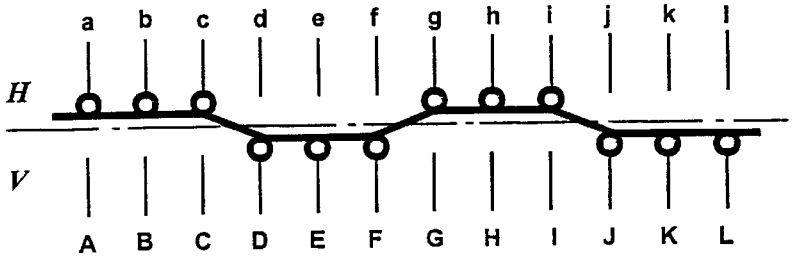
Fig. 5.4
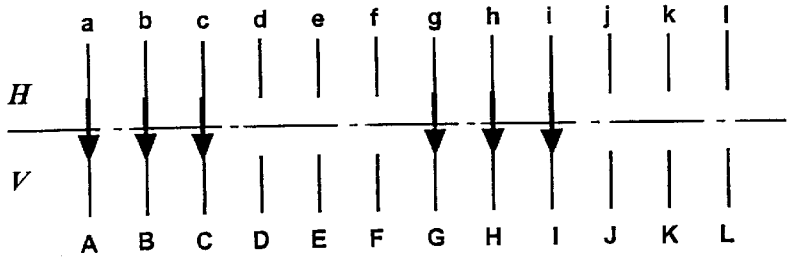

Fig. 5.5
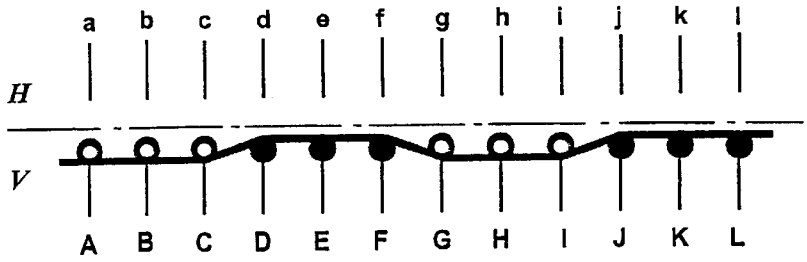
Fig. 5.6
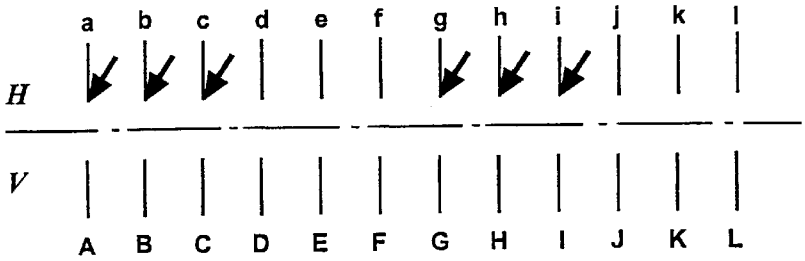
Fig. 5.7
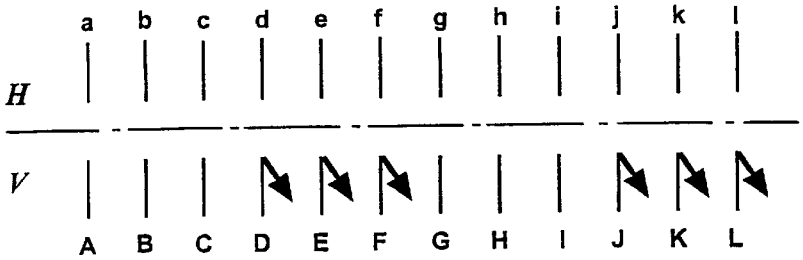
Fig. 5.8
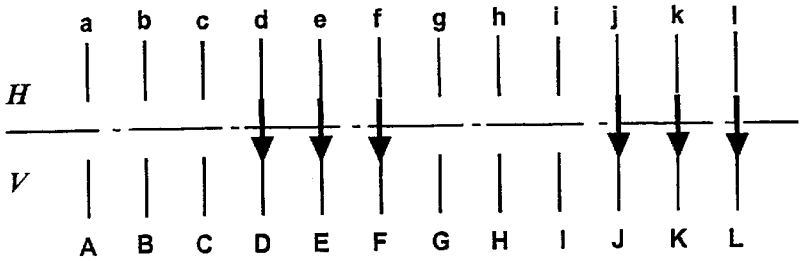
Fig. 5.9
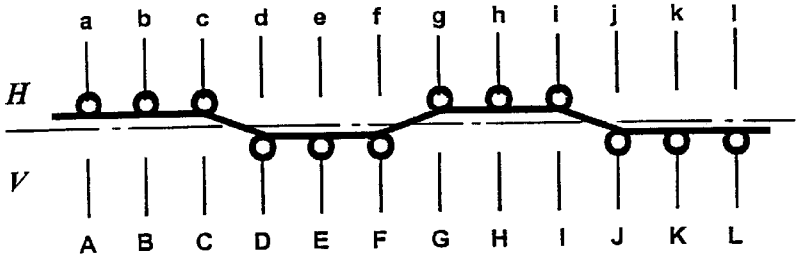

*Fig. 5.10*
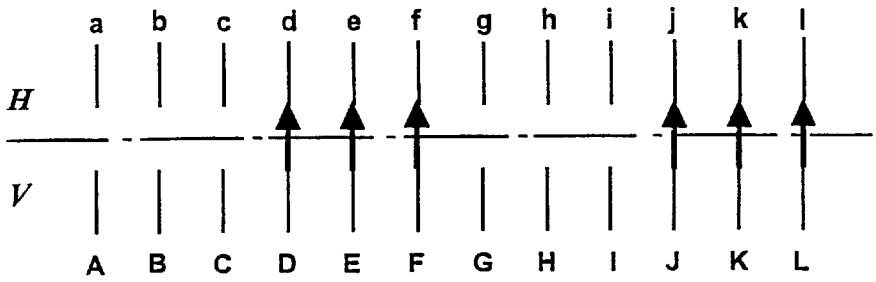
*Fig. 5.11*
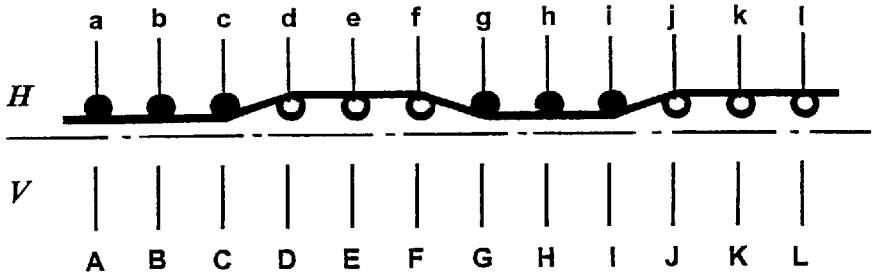
*Fig. 5.12*
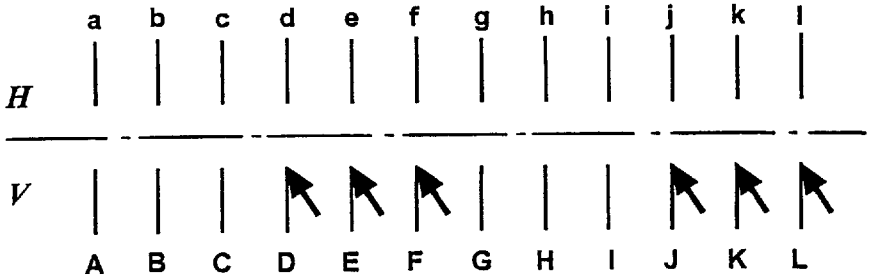

Fig. 6.0
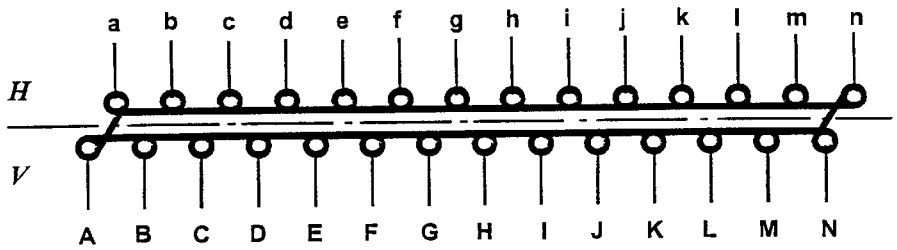
Fig. 6.1
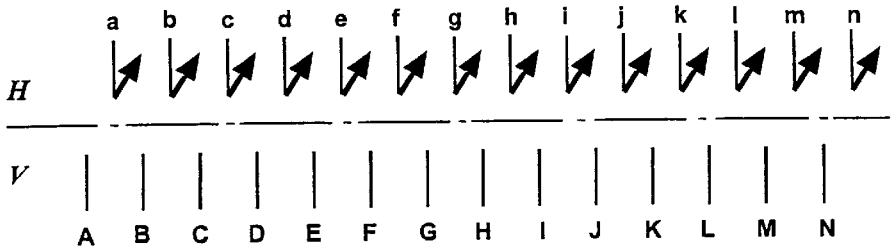
Fig. 6.2
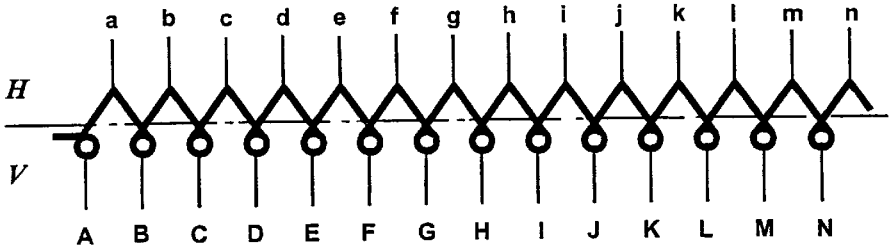
Fig. 6.3
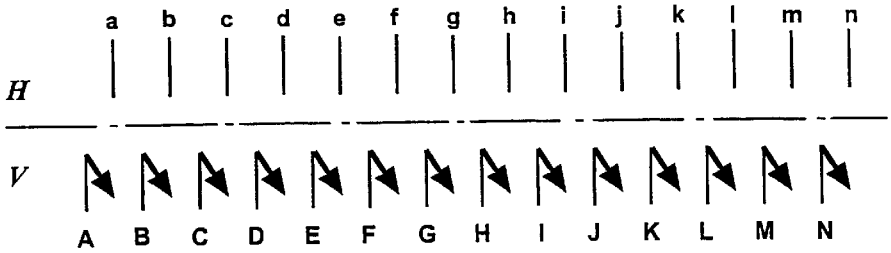
Fig. 6.4
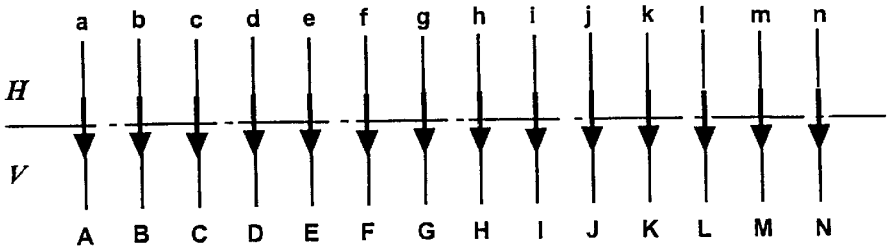

Fig. 6.5
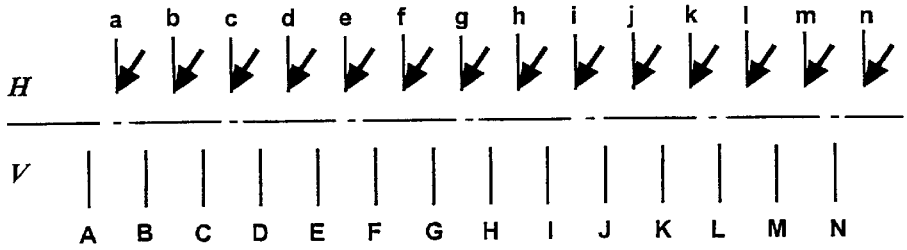
Fig. 6.6
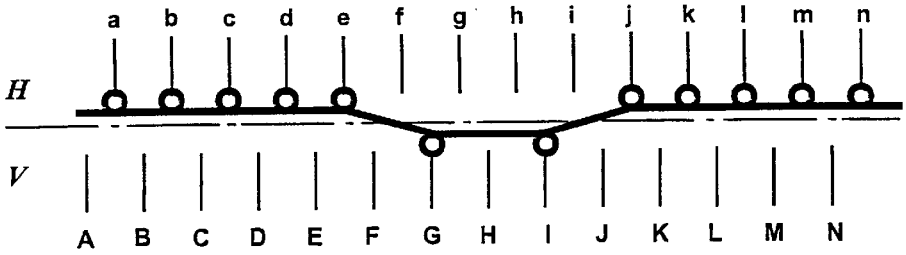
Fig. 6.7
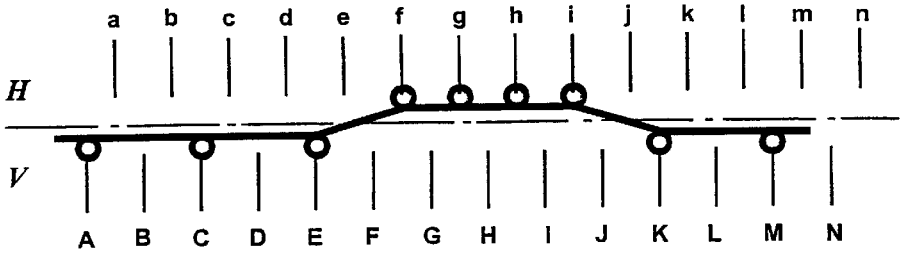
Fig. 6.8
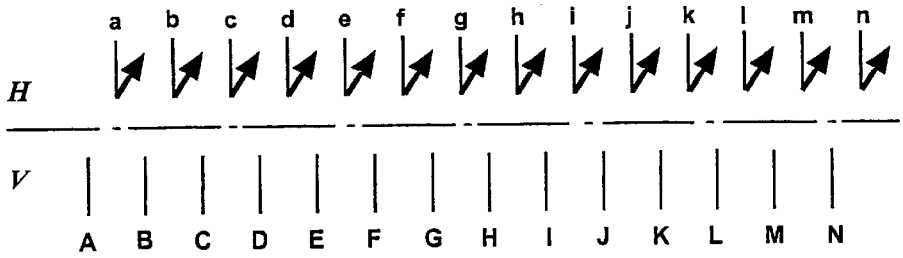
Fig. 6.9
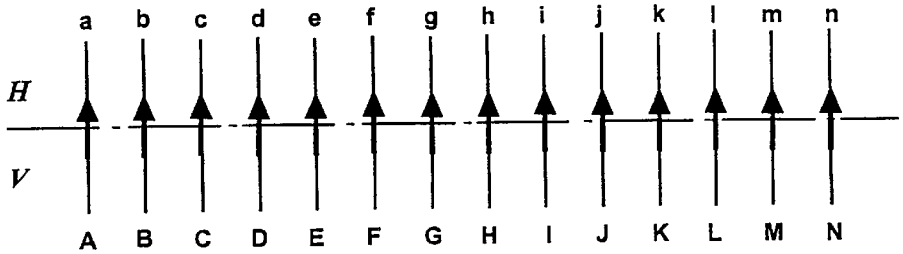

Fig. 6.10
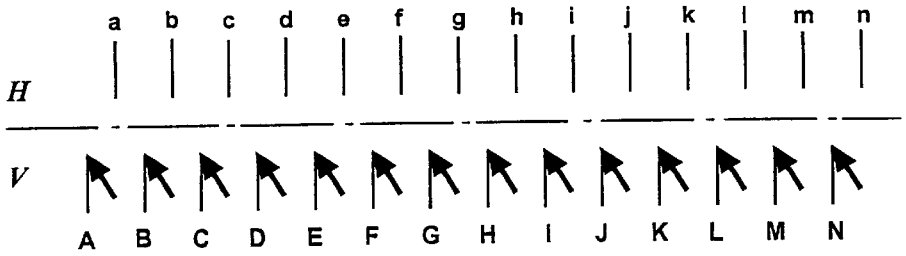
Fig. 6.11
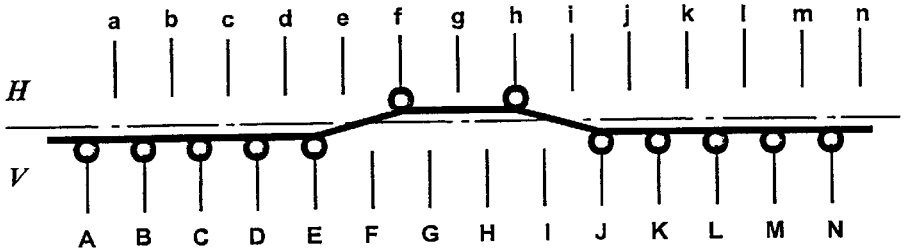
Fig. 6.12
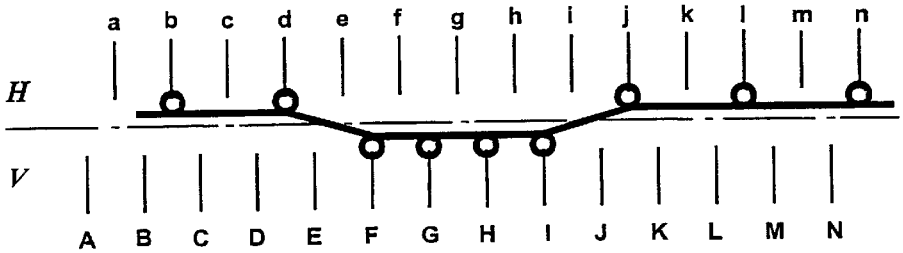

Fig. 7.0
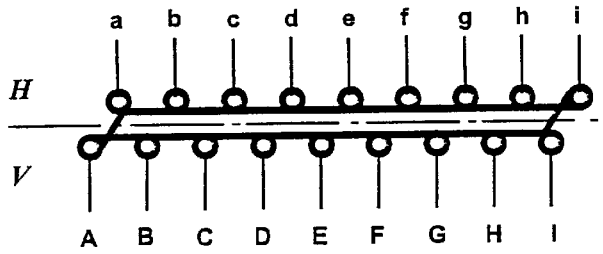
Fig. 7.1
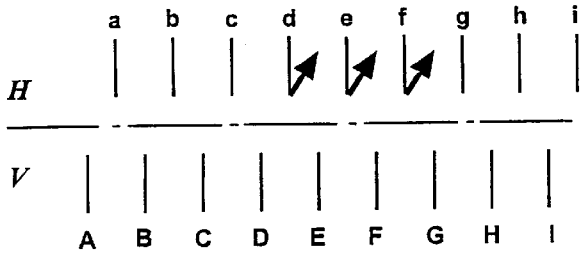
Fig. 7.2
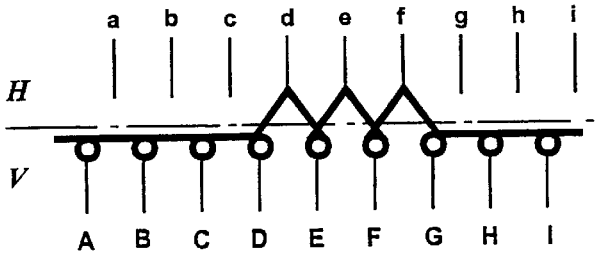
Fig. 7.3
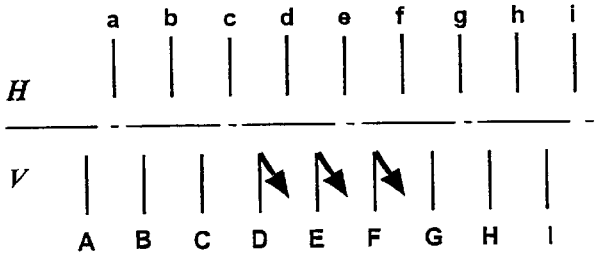
Fig. 7.4
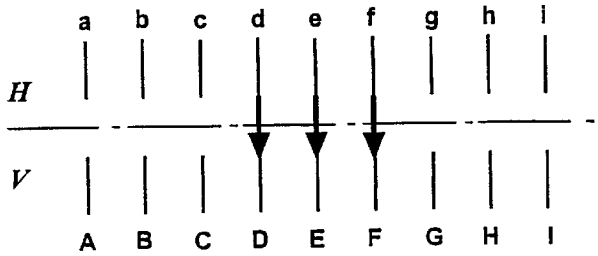

Fig. 7.5
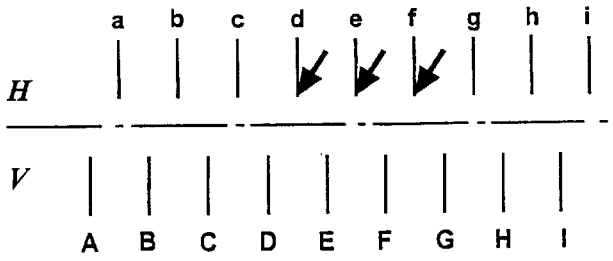
Fig. 7.6
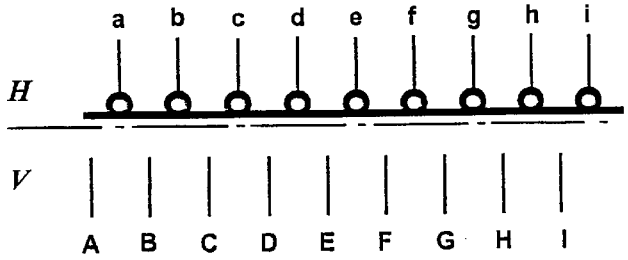
Fig. 7.7
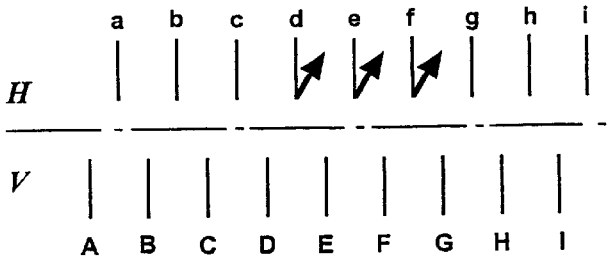
Fig. 7.8
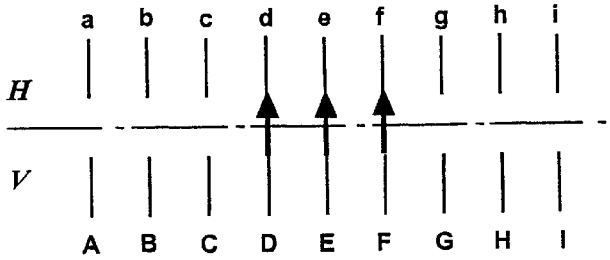
Fig. 7.9
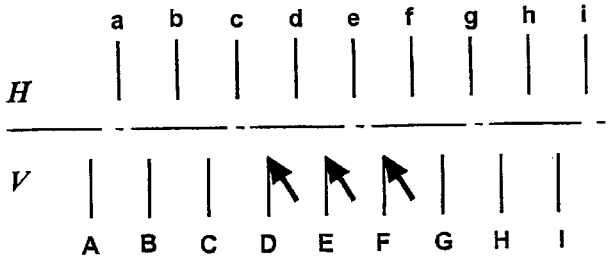

Fig. 7.10
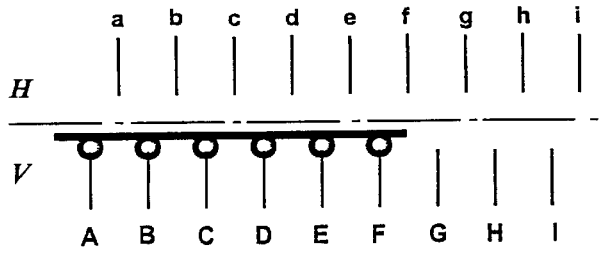
Fig. 7.11
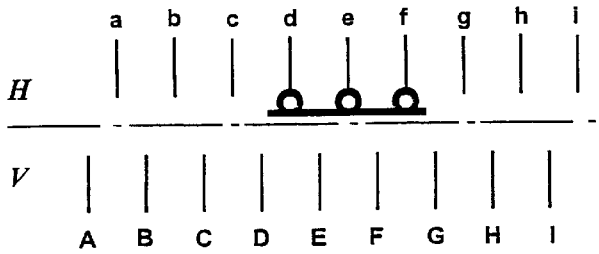
Fig. 7.12
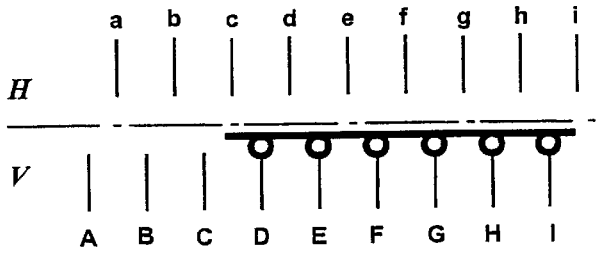
Fig. 7.13
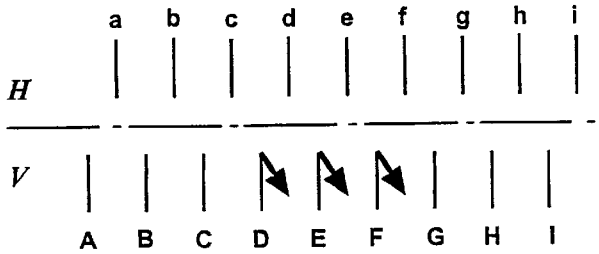
Fig. 7.14
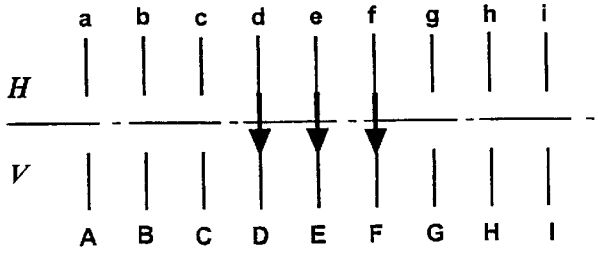

Fig. 7.15
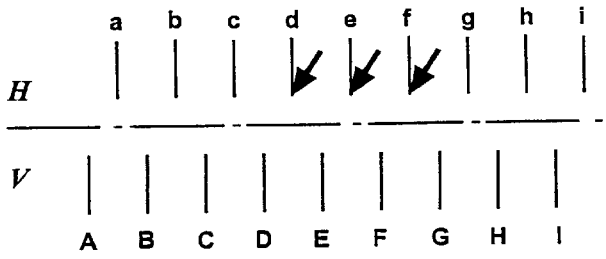
Fig. 7.16
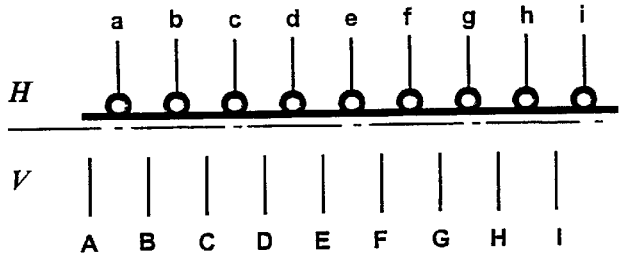
Fig. 7.17
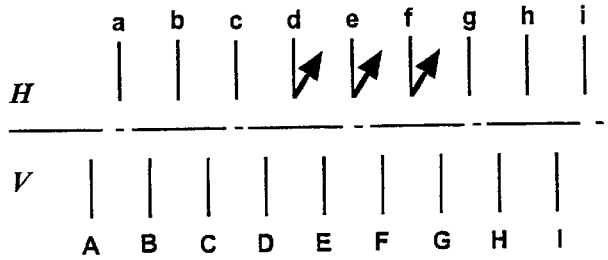
Fig. 7.18
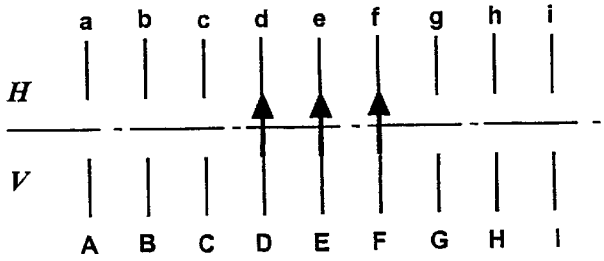
Fig. 7.19
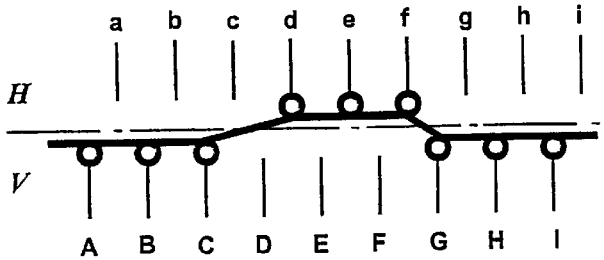

Fig. 9.0
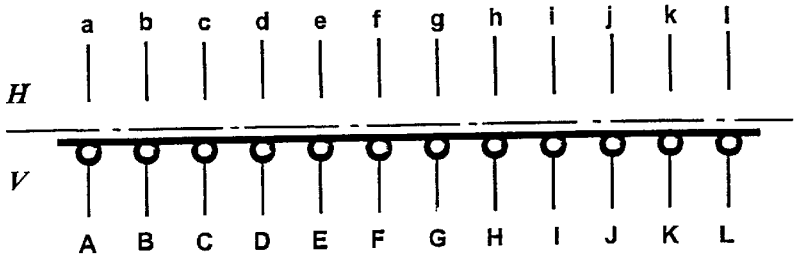
Fig. 9.1
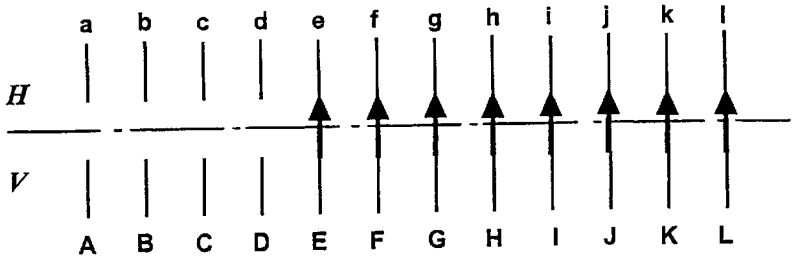
Fig. 9.2
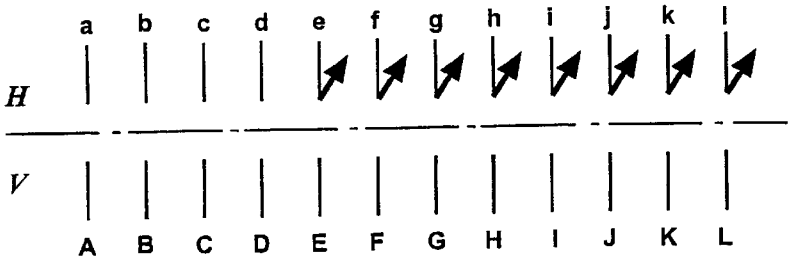
Fig. 9.3
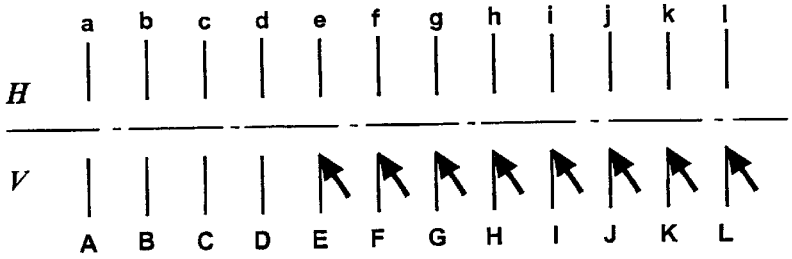
Fig. 9.4
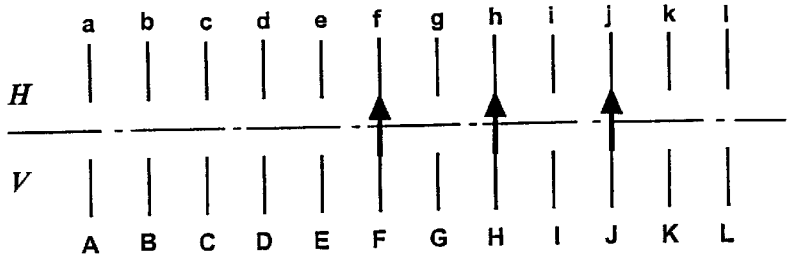

Fig. 9.5
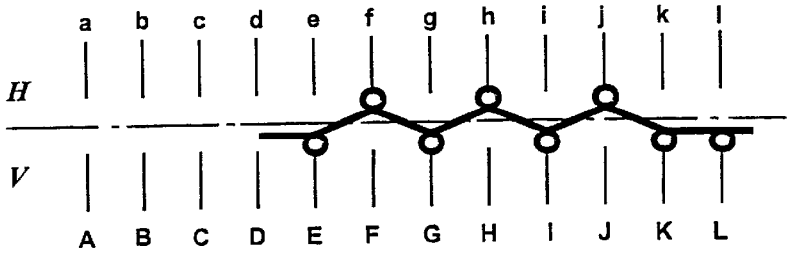
Fig. 9.6
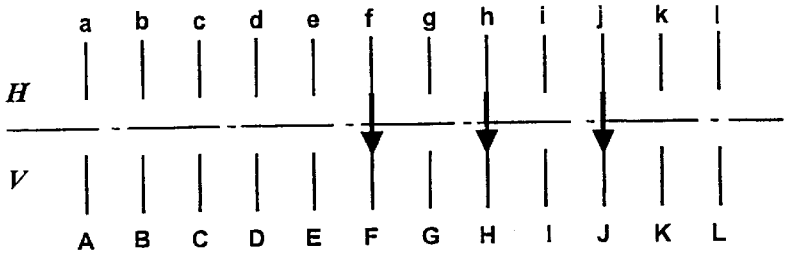
Fig. 9.7
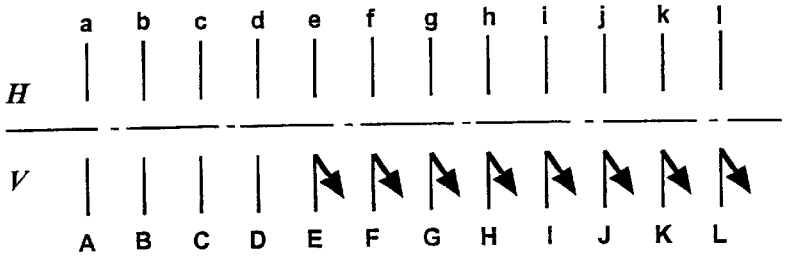
Fig. 9.8
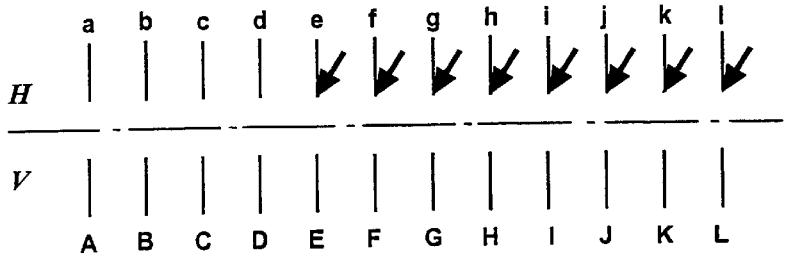
Fig. 9.9
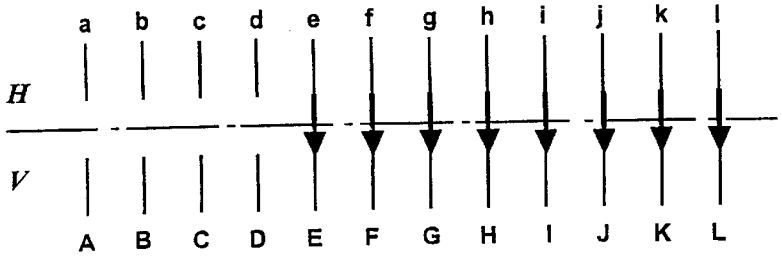

Fig.10.0
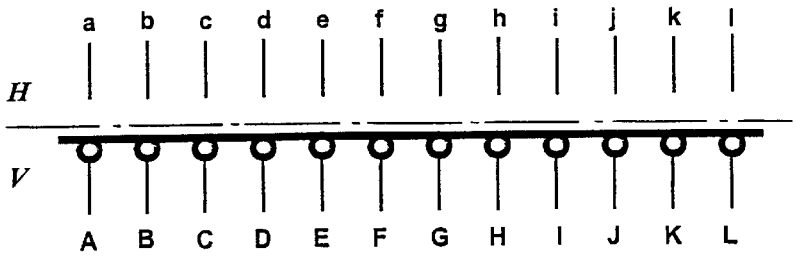
Fig. 10.1
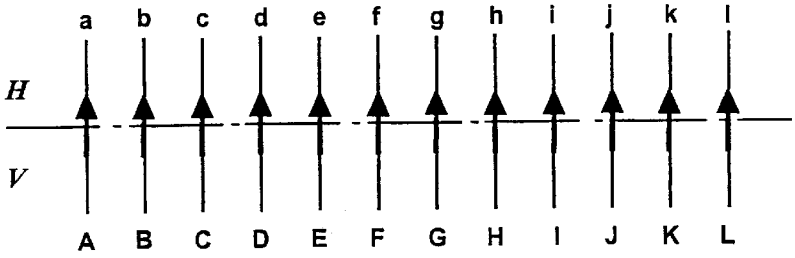
Fig. 10.2
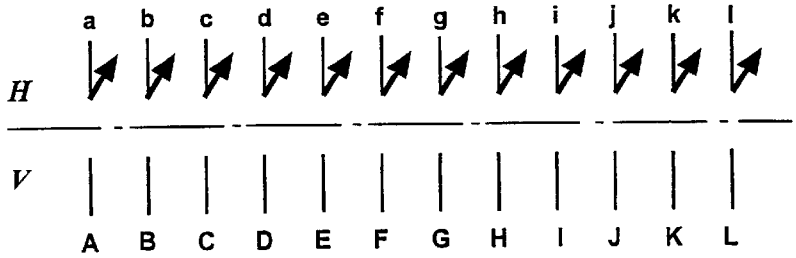
Fig. 10.3
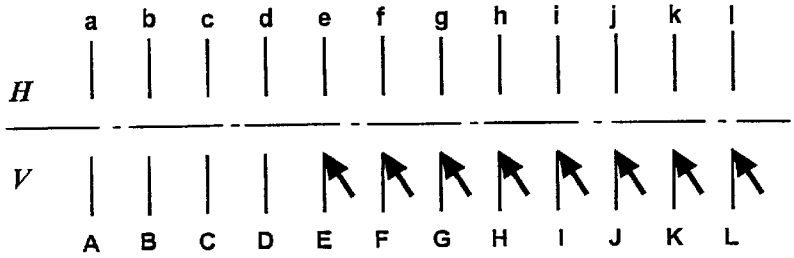
Fig. 10.4
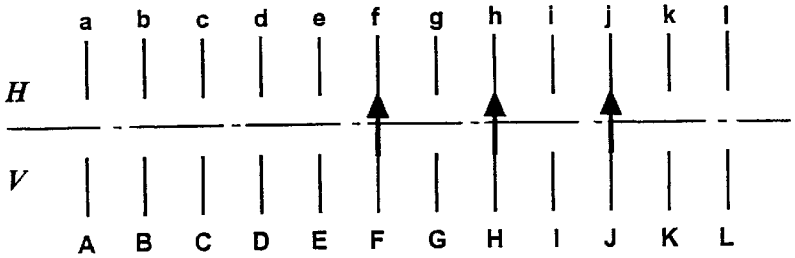

Fig. 10.5
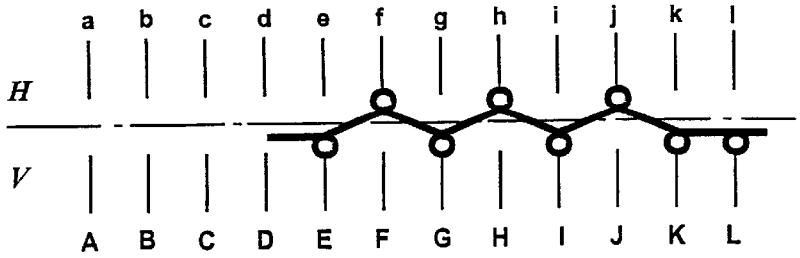
Fig. 10.6
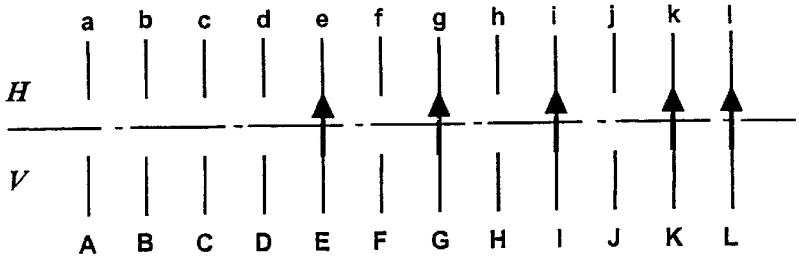
Fig. 10.7
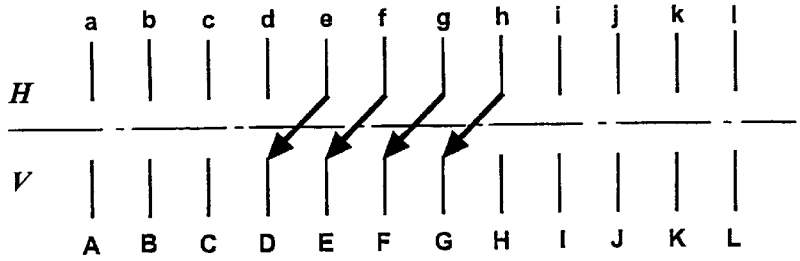
Fig. 10.8
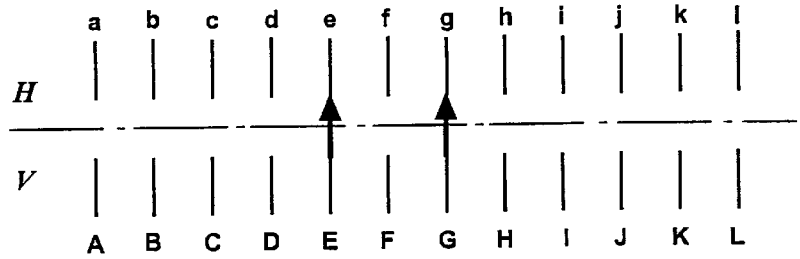
Fig. 10.9
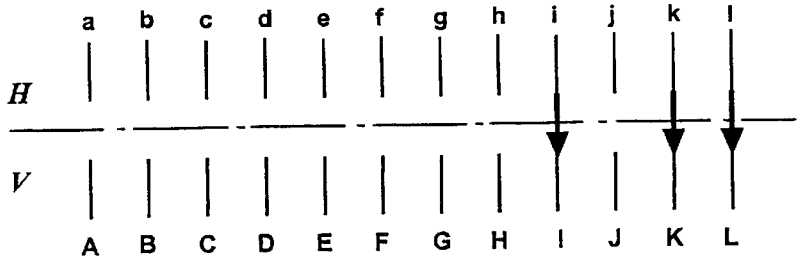

Fig. 10.10
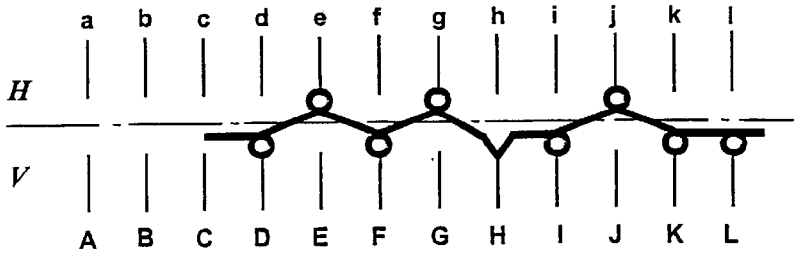
Fig. 10.11
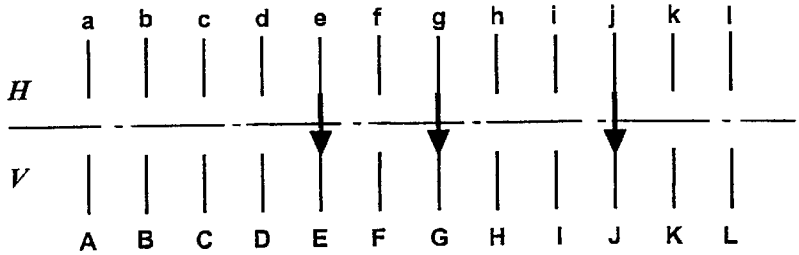
Fig. 10.12
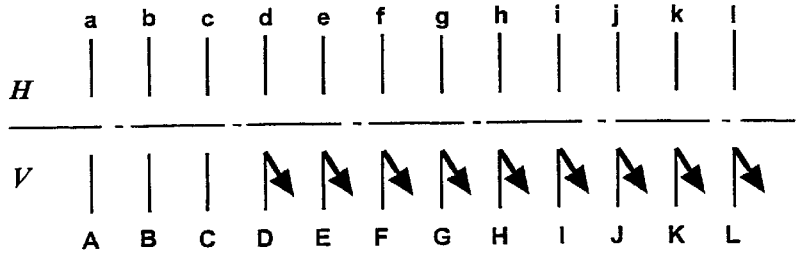
Fig. 10.13
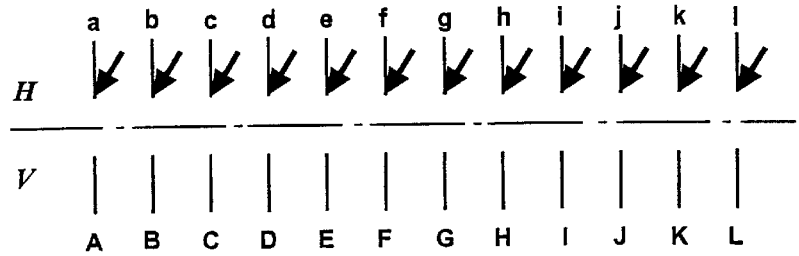
Fig. 10.14
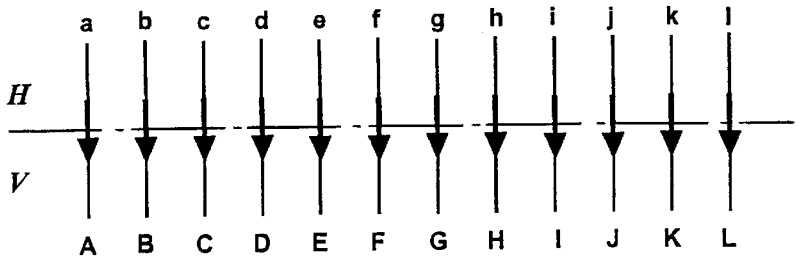

*Fig.10.15*
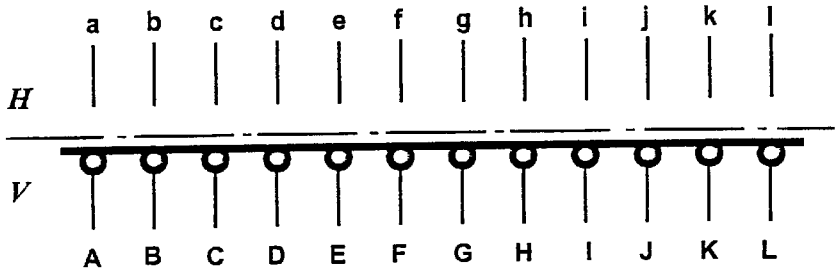

Fig.11.0
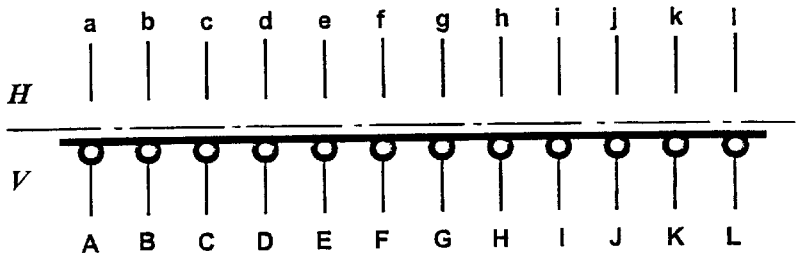
Fig. 11.1
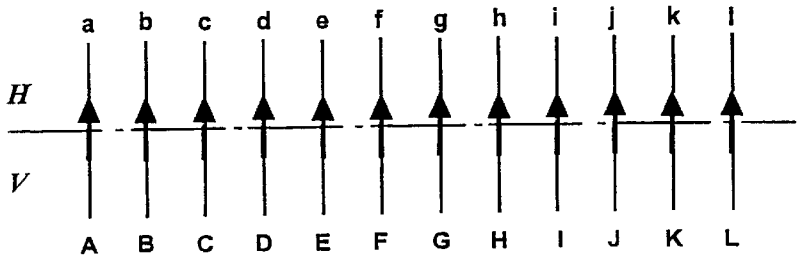
Fig. 11.2
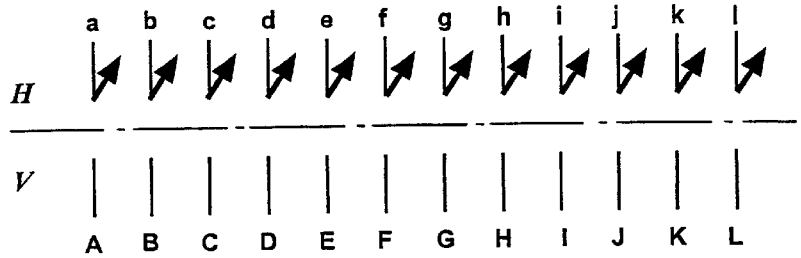
Fig. 11.3
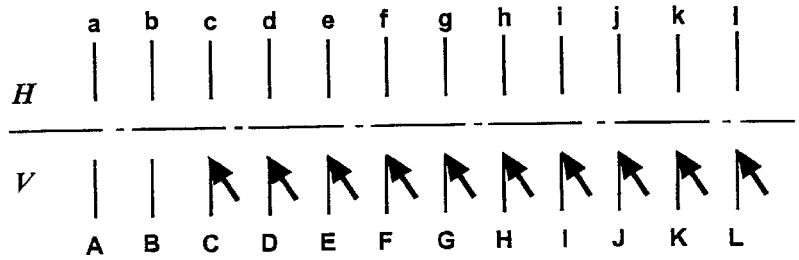
Fig. 11.4
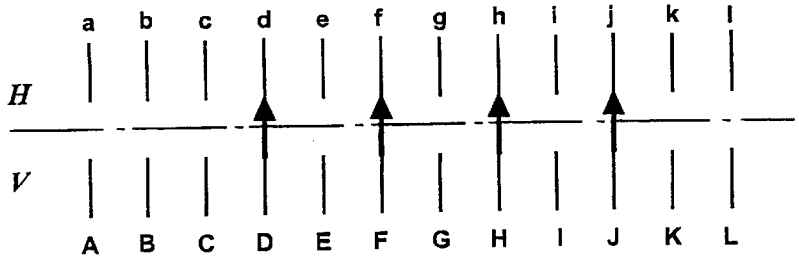

*Fig. 11.5*
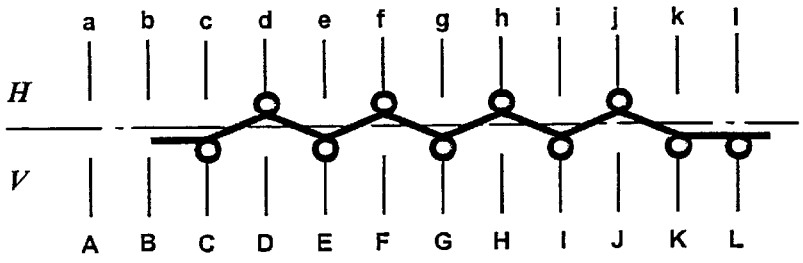
*Fig. 11.6*
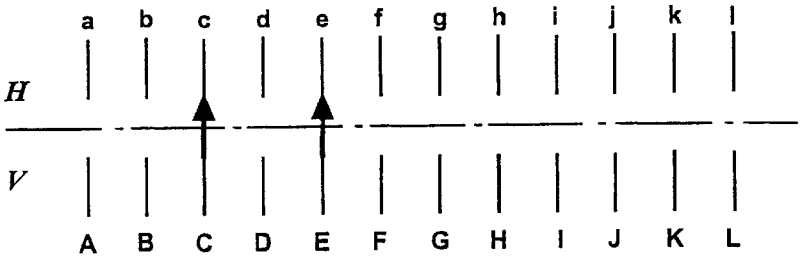
*Fig. 11.7*
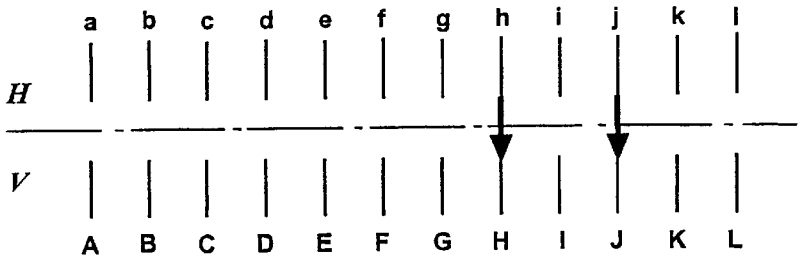
*Fig. 11.8*
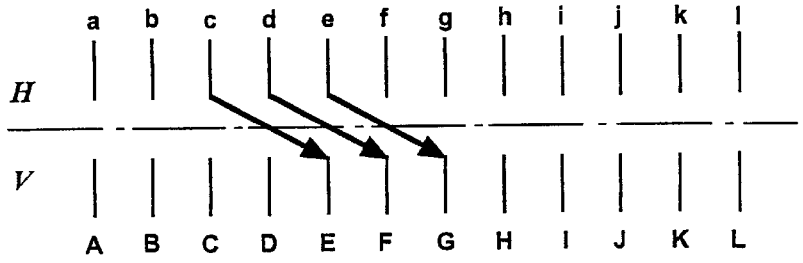
*Fig. 11.9*
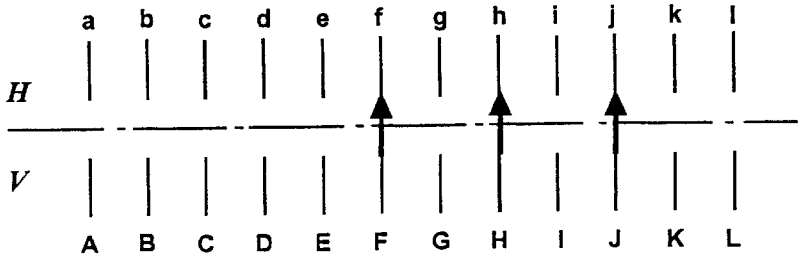

Fig. 11.10
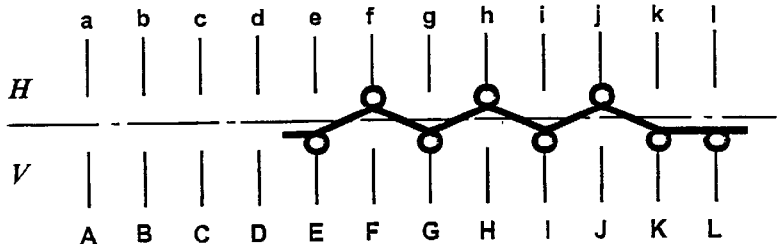
Fig. 11.11
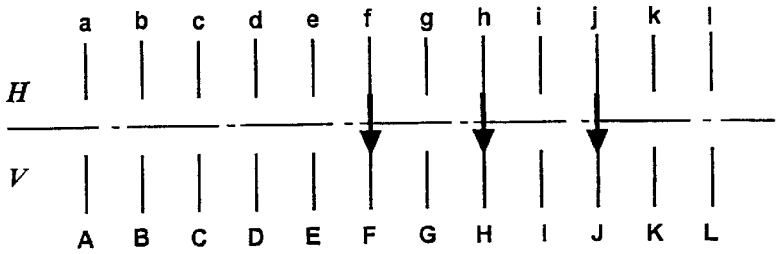
Fig. 11.12
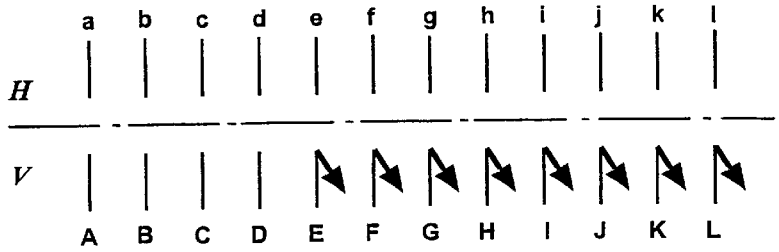
Fig. 11.13
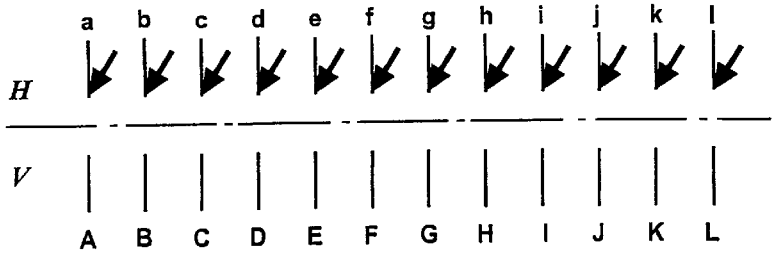
Fig. 11.14
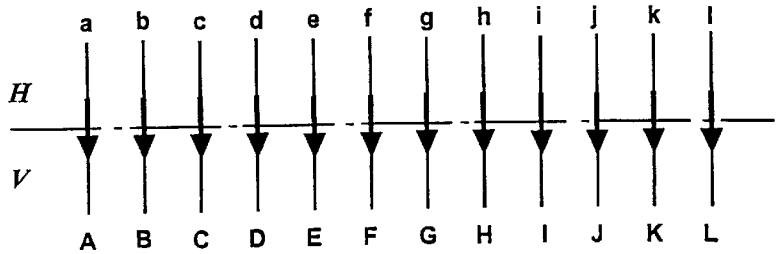

*Fig.11.15*
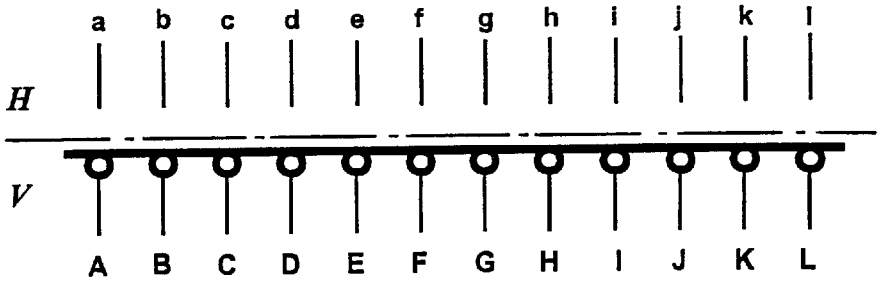

METHOD OF PRODUCING KNITTED ARTICLES WITH SEVERAL KNITTING PLANES

BACKGROUND OF THE INVENTION

The present invention relates to a method for producing knitted articles with several knitting planes on a two bed flat knitting machine.

When on flat knitting machines with two opposite needle beds, knitted products are produced by latch needles or slide needles, which require several knitting planes for their productions for example hose-roundrib knitted product, hose-roundjacquard knitted product, hose-round knitted product with integrated pockets or the like, or knitted products with parallel knitted parts for example a reverse, then it has been known to form in each needle bed the stitches for the corresponding knitted product sides at most with each second needle, since empty needles located therebetween are required for producing the additional knitting planes. For example, in the empty needles the left stitches must be formed on each corresponding needle bed. Also, the knitting of the jacquard design rear side on the needle bed located opposite to the design front side is possible only by free needles. The same is true for the knitting of the knitting planes for forming a pocket rear side or a reverse of a knitted product.

Because it is necessary to release each second needle, the thusly produced knitted pieces do not correspond in their appearance to normal knitted pieces of the corresponding machine quality, in which each needle is used for stitch formation. Such knitted pieces are difficult to combine with other knitted pieces of the same machine quality, for example with sleeves. The plate stitches are substantially increased, so that the knitted pieces have a lower shape stability and a more pronounced expansion in a longitudinal direction than in a transverse direction, when compared with knitted products in which the stitches are produced with all needles.

Knitted articles with several knitting planes, in which each needle of a needle bed can be pulled for stitch production for one knitting plane, are conventionally produced only on flat knitting machines with four needle beds. Knitting machines of this type are however technically very sensitive and have a relatively high cost for a production hour, which makes more expensive the manufacture of knitted products on these machines.

SUMMARY OF THE INVENTION

Accordingly, it is an object of the present invention to provide a possibility of producing on a two bed flat knitting machine the knitted products with several knitting planes, wherein each needle of a needle bed can be utilized for formation of stitches for the different knitting planes.

In keeping with these objects and with others which will become apparent hereinafter, one feature of present invention resides, briefly stated, in a method for producing knitting articles with several knitting planes on a two bed flat knitting machine, wherein all needles of one needle bed are used for formation of stitches for one knitting plane, wherein in accordance with the invention, the following steps are performed:

for forming a further knitting plane, the stitches hanging on the knitting needles which are required for this process are taken by transfer elements which are associated with these knitting needles, subsequently the transporting elements are offset with the stitches held on them or the associated needle bed by a half needle pitch, so that the transfer elements are located in gaps to the needles of the needle bed, stitches are taken from the opposite needle bed by the needles released from the stitches, and stitches for another stitching plane are formed, after ending the knitting process for the other knitting plane, the stitches of the needles are again transferred to the opposite needle bed, the transfer elements or the associated needle bed are displaced back by a half needle pitch, so that the transfer elements are again located over the needles of the associated needle bed, with the needle of the needle bed, stitches for the original knitting plane are again formed.

With this method it is possible to produce all knitted articles which require several knitting planes for their production, and thereby all needles of the both oppositely located needle beds can be used for the knitting process. For transferring of the stitches which are suspended on the knitting needles required for forming the further knitting plane to the transfer elements, the stitches which are suspended in the needles can be placed on the needle latch or, in the case of sliding needles, on the needle slider by needle extending and/or retracting movements, and subsequently the transfer elements can be introduced into the stitches and the needles can be pulled from the stitches, so that the stitches alone are suspended on the transfer element.

For placing the stitches on the needles for transfer by the transfer elements, several possibilities are provided. The stitches can be placed by a needle extending movement and subsequent needle retracting movement on the closed latches. The stitches can be placed however also by a needle advancing movement on the open latches of the needles. Both with the open and closed latches, the stitches are sufficiently tensioned so that the transfer elements can be introduced into the stitches.

With the use of slider needles, the stitches can be placed by a needle advancing movement with open sliders and a subsequent needle retracting movement with closed sliders, over the closed sliders. Therefore, similar conditions are provided for the transfer process as during placing of the stitches on the closed latches of the latch needles.

The present invention also deals with knitted products produced with the inventive method, in form of a hose-round-ribbed knitted product, a hose-round-jacquard knitted product, a hose-round-knitted product with knitted pocket as well as a knitted product which has a base knitted part and a reverse, whereby the reverse is produced as a parallel part to the base part. It is to be understood that also further knitted products can be produced with the inventive method.

The novel features which are considered as characteristic for the present invention are set forth in particular in the appended claims. The invention itself, however, both as to its construction and its method of operation, together with additional objects and advantages thereof, will be best understood from the following description of specific embodiments when read in connection with the accompanying drawings.

BRIEF DESCRIPTION OF THE DRAWINGS

FIGS. 5.0–5.12 are views schematically showing stitch courses of a method for producing a hose-round-ribbed knitted product;

FIGS. 6.0–6.12 are views schematically showing stitch courses of a method for producing a hose-round-knitted product with two color jacquard patterns;

FIGS. 7.0–7.19 are views schematically showing stitch courses of a method for producing a hose-round knitted product with a stitched pocket;

FIGS. 9.0–9.9 are views schematically showing stitch courses of a method for producing those switches of the knitted product of FIG. 8, in which the reverse has a constant width;

FIGS. 10.0–10.15 are views schematically showing stitch courses of a method for producing those regions of a knitted product of FIG. 8, in which a reverse is expanded; and FIGS. 11.0–11.15 are views schematically showing stitch courses of a method for producing those regions of the knitted product of FIG. 8 in which the reverse is reduced.

DESCRIPTION OF PREFERRED EMBODIMENTS

Figure 1:
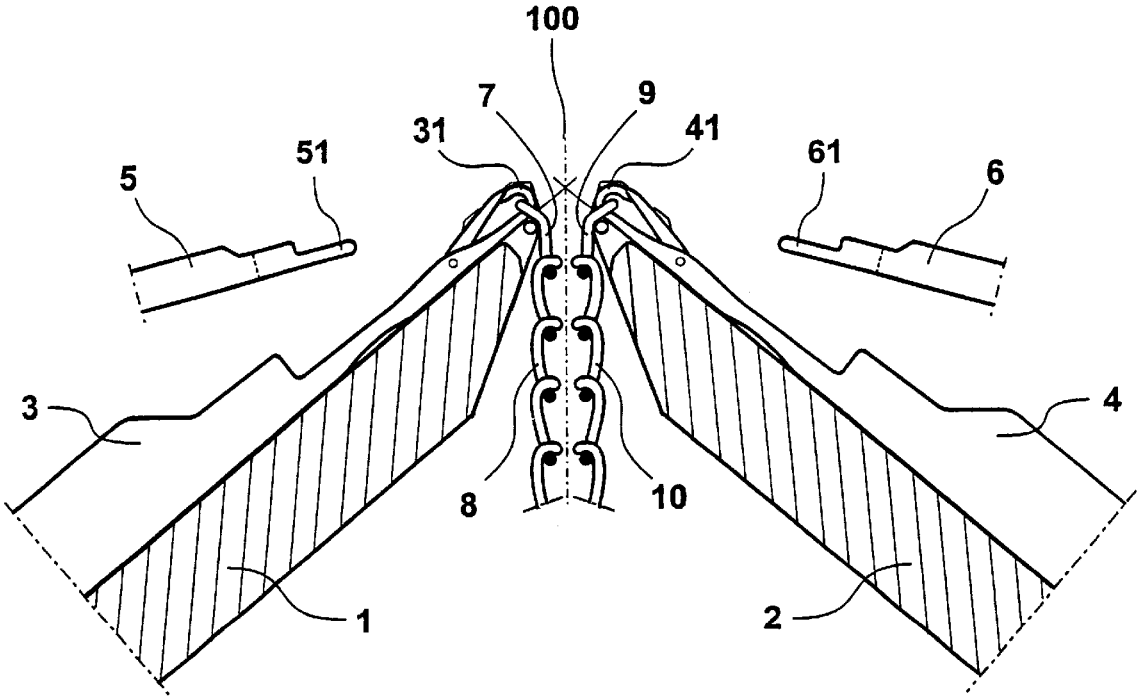
FIG. 1 is a view showing a partial cross-section through a front and a rear needle bed of a flat knitting machine with transfer elements.
Figure 2:
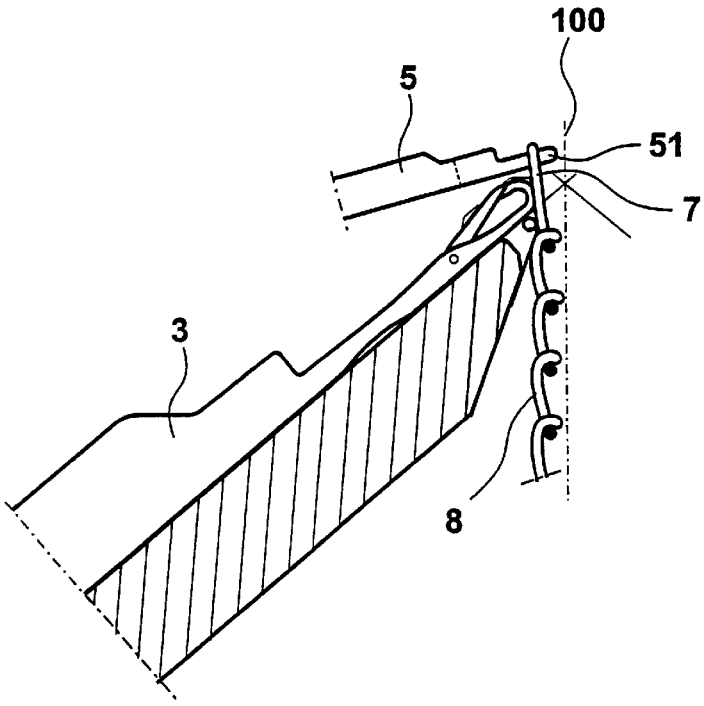
FIG. 2 is a view showing a partial transverse section through a front needle bed of the flat knitting machine of FIG. 1 during the transfer of a stitch to a transfer element.

FIG. 1 shows front and rear needle beds 1, 2 of a flat knitting machine in the region of elements which form the stitches. In particular two needles 3 and 4 as well as associated transfer elements 5 and 6 are illustrated. Corresponding stitches 7 and 9 are suspended in the hooks 31 and 41 of the needles 3 and 4. The transfer elements 5 and 6 have tips 51 and 61, with which they can be introduced into the stitches 7 and 9, as shown in FIG. 2, as an example of the transfer element 5 and the stitch 7. The transfer element 5 is driven out from its stationary position shown in FIG. 1, but only so far that the central line 100 of the knitting machine is not exceeded. Therefore, by the stitch 7 which is held on the transfer element 5, a select guidance for the forming of further knitting planes is not prevented.

Figure 3:
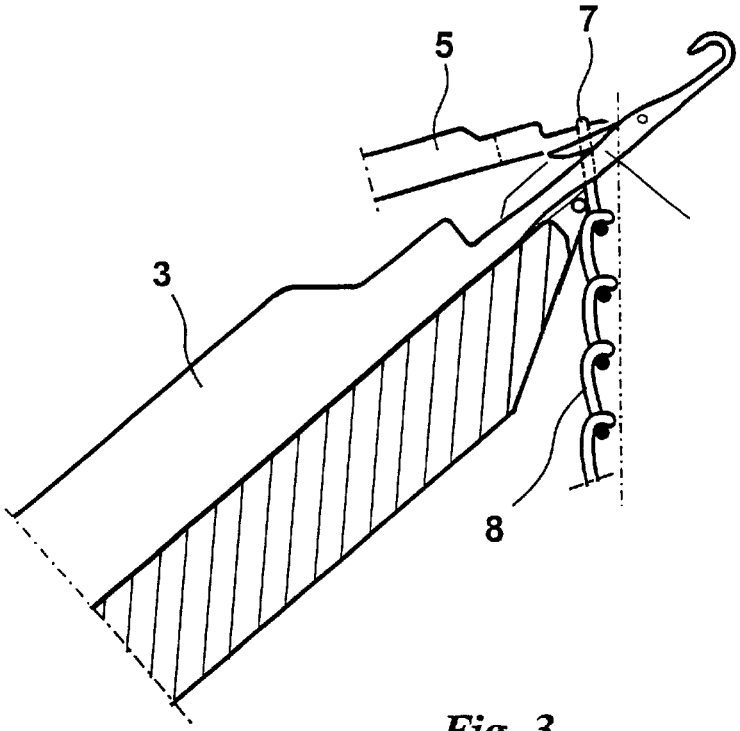
FIG. 3 is a partial cross-section corresponding to FIG. 2, through the front needle bed after an offset of the transfer element by a half needle pitch.

In FIG. 3 the stitch transfer element 5 is offset relative to the needle 3, so that the needle 3 in addition to the stitch 7 can perform all knitting functions for forming a further knitting plane, for example for forming stitches, transferring stitches, or taking stitches.

Figure 4:
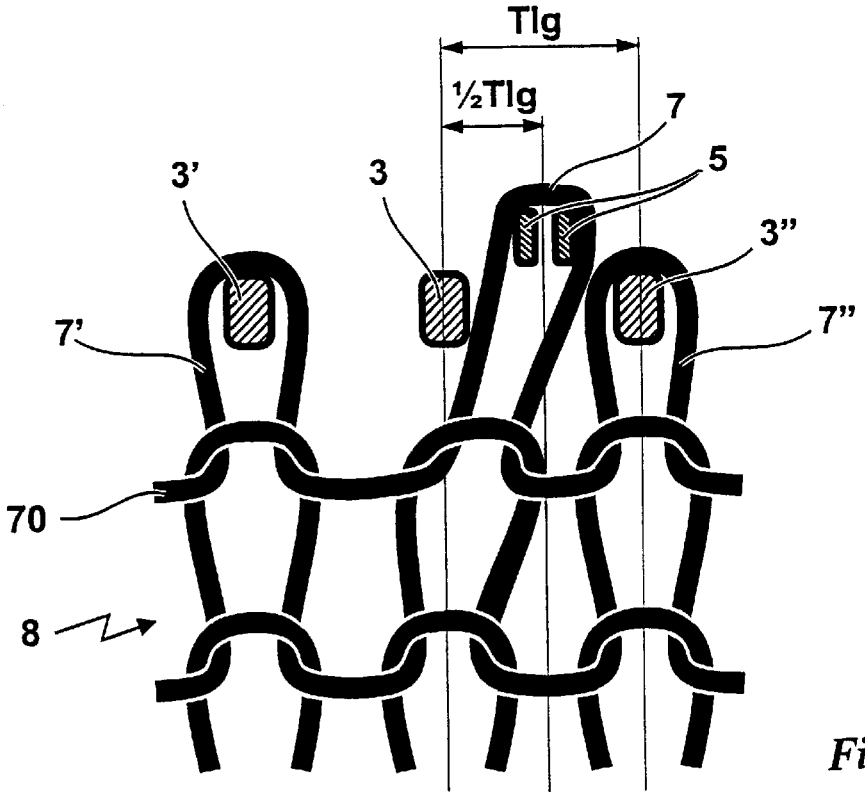
FIG. 4 is a view schematically showing a stitch set suspended on needles, with one stitch transferring to a transfer element.

FIG. 4 shows a course of a knitting row 70 within one stitch unit 8. A stitch 7' is located on a needle 3' and a stitch 7" is located on the needle 3". The stitch 7 is. located on the stitch transfer element 5, which is offset by a half pitch Tig relative to the needle 3. The needle 3 is idle and can be utilized for forming a stitch for a further stitch plane.

FIGS. 5.0–5.12 illustrate the production of a hose-roundribbed knitted product, which has over its whole periphery an alternating distribution of three right stitches and three left stitches. The method steps shown in individual figures can be provided partially in correspondence with the number of the knitting systems of the flat knitting machine, so that the knitted product can be produced with a minimum carriage movement.

In FIG. 5 the right stitches are shown with the filled stitch head and the left stitches are shown with empty stitch head. The right stitches of the front and rear needle beds V, H are each formed on these needle beds, the left stitches are formed on the opposite needle bed. In accordance with FIG. 5.1 the right stitches are transferred on the needles a, b, c, and g, h, i of the rear needle bed H, on corresponding transfer elements as identified with inclined arrow, which simultaneously symbolize the offset of the stitch elements relative to the needles a, b, c, g, h, i, by a half pitch to the right. Subsequently as shown in FIG. 5.2, the left stitches of the front needle bed F are suspended on the left needles a, b, c, g, h, i, of the rear needle bed H, and subsequently in FIG. 5.3 a knitting row is formed for the front hose part on the front needle bed V. The right stitches are produced on the front needle bed V and the left stitches are produced on the rear needle bed H. The left stitches formed in the rear needle bed H are transferred in FIG. 5.4 to the front needle bed V. Thereby a further knitting row is formed on the front needle bed V for the hose knitted product as shown in FIG. 5.5. Subsequently, the stitches of the rear needle bed H which are taken by the transfer elements in accordance with FIG. 5.6 are again transferred to the associated needles a, b, c, g, h, l.

For forming stitches for the rear partial knitted product, in FIG. 5.7 the right stitches of the front needle bed V are transferred to the stitch transfer elements, and subsequently in FIG. 5.8 the left stitches of the rear needle bed H are transferred to the now free needles of the front needle bed V. Therefore a knitting row from the rear hose section can be formed. The right stitches are produced on the rear needle bed H and the left stitches are produced on the front needle bed V. Subsequently, the left stitches formed on the front needle bed V are transferred onto the needles of the rear needle bed H, and in FIG. 5.11 the shown stitch union is provided for the rear hose section. After this, the stitches of the front needle bed which are held on the transfer elements are again transferred to the needles of the front needle bed V as shown in FIG. 5.12.

With the step sequence of FIGS. 5.0–5.2 the hose-round rib knitted piece is increased in the housing by one knitting row. The cycle of this process steps is repeated until the required length of the knitted piece is reached.

FIGS. 6.0–6.2 show the production of a hose-round knitted product with a two color-jacquard pattern in accordance with the inventive method. For the jacquard design of the rear hose knitted section, the rear side is formed on the front needle bed, and for the jacquard design of the front hose knitted section the rear side is formed on the rear needle bed.

In accordance with FIG. 6.0, a hose round piece is formed with all needles of the front needle bed V and with all needles of the rear needle bed H. In FIG. 6.1 the first step of the transfer from smooth hose knitted product to hose-jacquard knitted product is shown. All stitches of the rear needle bed H are transferred to the transfer elements and subsequently the transfer elements are offset relative to the associated needles by a half needle stitch to the right. Subsequently as shown in FIG. 6.2, in the now free needles of the rear needle bed H, tuck loops are inserted, while all needles of the front needle bed V form stitches. In FIG. 6.3 it is shown how subsequently all stitches of the front needle bed V are transferred to the transfer element. The released needles then take the tuck loops which were formed on the rear needle bed H as shown in FIG. 6.4. After this the stitches of the rear needle bed which are suspended on the transfer elements are transferred back into the released needles of the rear needle bed H as shown in FIG. 6.5. In FIG. 6.6 it is then shown how for the rear hose knitted section, with the needles a–e and j–n the jacquard visible side is formed with a thread in a first color. The needles g and i of the front needle bed V form the jacquard rear side.

Subsequently in FIG. 6.7 the jacquard visible size is formed in a second color with a thread in a second color and with the needles f–i. The needles A, C, E, K, M, of the front needle bed V form the jacquard printed side. Subsequently all stitches of the jacquard pattern row of the rear hose knitting section are transferred to the transfer elements in FIG. 6.1, and then the transfer elements are offset to the right by a half pitch. The stitches of the rear needle bed are therefore free for forming the rear side of the jacquard design of the front hose knitted section. For this purpose in FIGS. 6.9 first all stitches of the front needle bed V are transferred to the free needles of the rear needle bed H. Then, in FIG. 6.10 the stitches located intermediately on the transfer elements are transferred to the needles of the front needle bed V. In FIG. 6.11 it is then shown how for the front hose knitted section with the needles A–E and J–N the jacquard visible side is formed with the thread of the first color. The needles f and h on the rear needle bed H form the jacquard rear side. In FIGS. 6.12 it is shown how for the front hose knitted section with the needles f–i the jacquard visible side is formed with the threads of the second color. The needles b, d, j, l, n, of the rear needle bed H form the jacquard printed side.

The method steps shown in FIGS. 6.3–6.12 describe the formation of a stitch row of the jacquard pattern. This cycle of the method steps must be repeated until the jacquard pattern reaches its rapport height.

FIGS. 7.0–7.19 show the method of producing a hose-round-knitted product with a knitted pocket on the front side. In the region of the pocket an additional knitting plane is required on the rear needle bed H for the pocket rear side.

FIG. 7.0 shows a hose-round knitted product which is knitted with all needles of the front and rear needle bed V, H. In FIG. 7.1 the to transition is shown from smooth-right knitted product of the front hose knitting side to knitting plane of the pocket. For this purpose the three stitches of the needles d, e, f, are transferred to the transfer elements and subsequently the transfer elements are offset to the right by a half needle pitch. Subsequently in FIG. 7.2 with the needles of the front needle bed, stitches and tuck loops are formed on the empty needles of the rear needle bed d, e, f. The tuck loops form the start row for the pocket rear side. In FIG. 7.3 it is then shown how the stitches of the needles D, E, F of the front needle bed V are transferred to the transfer elements, before in FIG. 7 the suspension of the tuck loops from the rear needle beds H to the now free needles D, E, F, of the front needle bed V is performed. The stitches of the rear needle bed H which are intermediately placed on the transfer elements are transferred back to the now empty needles d, e, f of the rear needle bed as shown in FIGS. 7.5. Subsequently in FIG. 7.6 the formation of a stitch row for the rear hose knitted side is performed. Then again the stitches in the region of the pocket rear side (needles d, e, f) of the rear needle bed H are transferred to the transfer elements and are held there as shown in FIG. 7.7. Subsequently the stitches of the front needle bed V are transferred from the needles D, E, F, onto the now empty needles of the rear needle bed H. The stitches which are held on the transfer elements are now transferred to the freed needles of the front needle bed V as shown in FIGS. 7.9.

FIGS. 7.10 shows the formation of the stitches with the needles A–F on the front needle bed. The needles A, B, and C knit for the front hose side, and the needles D, E, F, knit for the front side of the pocket. FIG. 7.11 shows how subsequently for the needle side of the pocket, stitches are formed with the needles d, e, f, of the rear needle bed. Subsequently with the needles D–l stitches are formed on the front needle bed V, while the needles D–F form again stitches for the front side of the pocket, and the needles G–E form the stitches for the hose knitted front side. As shown in FIGS. 7–13 then the stitches of the pocket front side D, E, F, are again intermediately placed on the transfer elements, and subsequently the opposite stitches of the rear needle bed H are transferred to the now free needles of the front needle bed V as shown in FIGS. 7.14. In FIG. 7.15 the stitches which were intermediately supported on the transfer elements are again transferred back to the empty needles d, e, f of the rear needle bed H. Subsequently in FIG. 7.16 the stitches are formed with all needles of the rear needle bed H. Then again the back transfer of the stitches on the needles d, e, f, of the rear needle bed H to the transfer elements is performed as shown in FIG. 7.18. Then the stitches of the opposite needles of the front needle bed V are transferred to the now empty needles as shown in FIG. 7.18, before the needles E–C and G–I of the front needle bed V form stitches for the front hose knitted product and the needles d–f of the rear needle bed forms stitches for the rear side of the pocket as shown in FIG. 7.19.

The method steps of FIGS. 7.4–7.19 describe the production of two stitch rows on the front and rear sides of the hose knitted product. This cycle of method steps must be repeated until the desired height of the pocket is reached.

Figure 8:
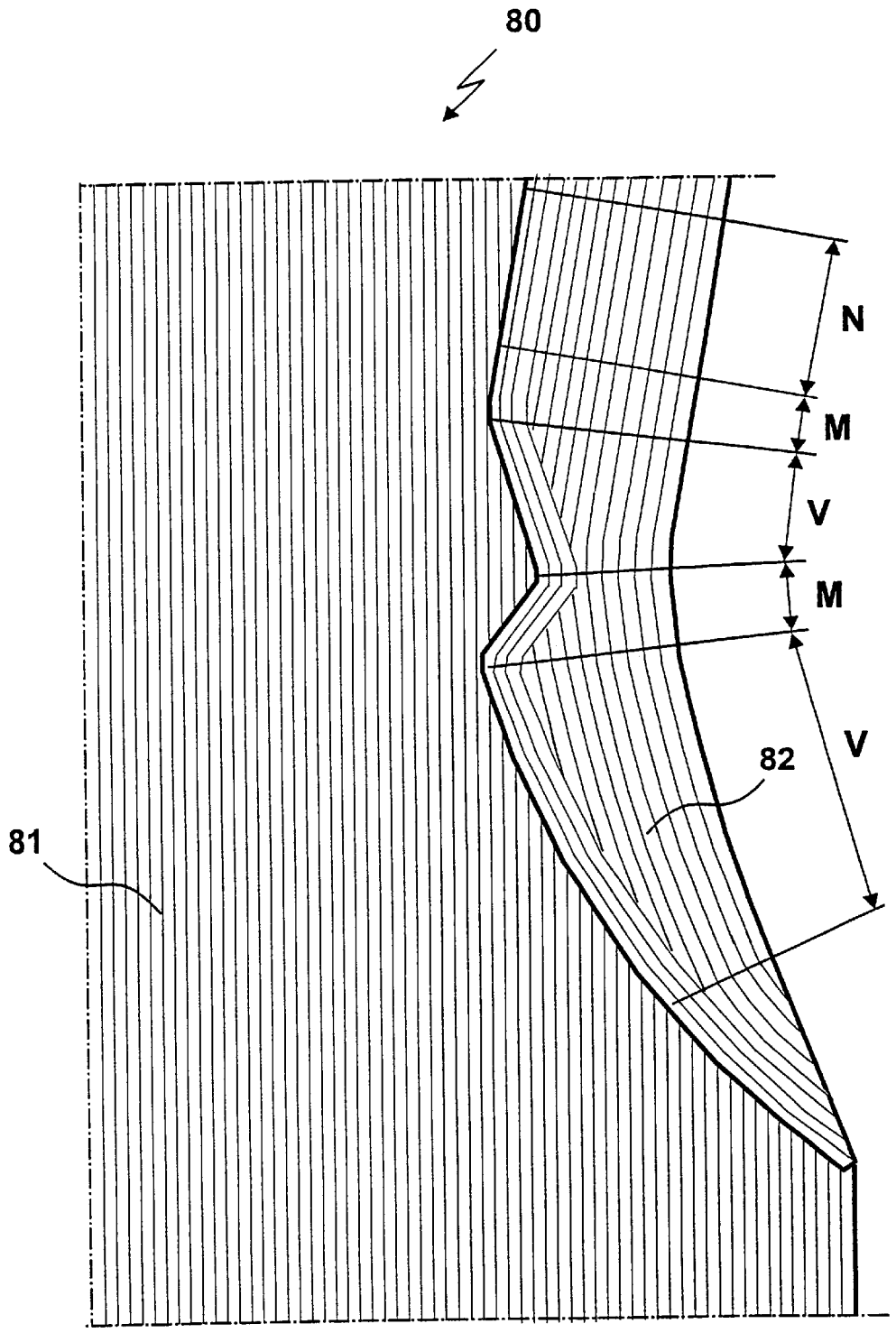
FIG. 8 is a schematic partial view of a knitted product with a stitch reverse.

FIG. 8 shows a section of a knitted product 80 which is composed of a base knitted piece 81 and a reverse 82 which is knitted on it. The reverse 82 is produced as 1:1 parallel part knitted piece to the base knitted piece 81. It is composed of a region N with a constant width, two regions M in which the knitted width is reduced, and two regions V in which the knitting width is increased.

FIGS. 9.0–9.9 show the stitch course of a production method for the knitted product 80 shown in FIG. 8 in the region N, FIGS. 10.0–10.15 show it in the regions V in which the reverse is increased, and FIGS. 11.0–11.15 show it in the regions M in which the reverse is reduced. In all three FIGS. 3 the knitted article 80 is formed with the use of an inventive method on a flat knitting machine with two needle beds. For producing the reverse 82, additional knitting planes must be provided at the front and rear needle beds V, H.

FIG. 9.0 shows how for the base knitted part 81 shown in FIG. 8 a stitch row is formed on the front needle bed V. Subsequently in FIG. 9.1 the stitches of the base knitted piece 81 which are located behind the reverse 82 are transferred from the needles of the front needle bed V up to the needles of the rear needle bed H. These stitches are subsequently transferred to the transfer elements, and the transfer elements are displaced to the right by a half needle pitch as shown in FIG. 9.2. The stitches which form the both knitting planes of the reverse 82 are located on the stitch transferring elements of the front needle bed V. They are transferred in FIG. 9.3 again to the associated needles of the front needle bed V. In FIG. 9.4 it is shown how the stitches which form the rear plane of the reverse 82 are transferred from the needles on the front needle bed V to the needles of the rear needle bed H. Subsequently, a 1:1 knitting row is formed for the reverse as shown in FIGS. 9.5. Thereafter the stitches of the rear plane of the reverse 82 are taken by the needles of the rear needle bed H on the needles of the front needle bed V as shown in FIG. 9.6. In accordance with FIG. 9.7 subsequently all stitches which form the reverse are taken by corresponding transfer elements of the front needle bed V and offset by a half pitch to the right. The stitches which are intermediately supported on the transfer elements are now transferred to the released needles of the rear needle bed as shown in FIG. 9.9 and subsequently they are transferred to the needles on the front needle bed as shown in FIGS. 9.9. After the cycle of the process steps shown in FIGS. 9.0–9.9 the knitted product is grown in the base knitted piece 81 and in the reverse 82 by one stitch row. This cycle is repeated until the knitted product 80 reaches its desired length, or the reverse 82 must be reduced or expanded.

FIG. 10 shows a method for expanding of the reverse 82. FIGS. 10.0–10.5 exactly correspond to FIGS. 9.0–9.5. In FIG. 10.6 it is shown how the stitches which form the front plane of the reverse 82 are transferred from the needles of the front needle bed to the needles of the rear needle bed. The rear needle bed is subsequently offset to the left by one pitch, and the four outer reverse stitches are transferred to the front needle bed V as shown in FIG. 10.7. Subsequently the rear needle bed H is again. brought to a base position and the stitches for the rear plane of the offset section of the reverse 82 are transferred to the rear needle bed as shown in FIG. 10.8. The stitches for the front plane of the not offset section of the reverse 82 are transferred to the front needle bed as shown in FIG. 10.9. FIG. 10.10 shows how for the reverse expanded by a needle, a 1:1 stitch row is formed. The needle H of the front needle bed V forms a loop. Subsequently the stitches of the rear plane of the reverse are transferred to the front needle V as shown in FIG. 10.1 1 before all stitches which form the reverse are taken by the corresponding transfer elements of the front needle bed V and offset by a half pitch as shown in FIG. 10.12. The stitches of the base knitted piece 81 are subsequently transferred from the transfer elements on the associated needles of the rear needle bed H as shown in FIGS. 10.13 and then transferred to the front needle bed V as shown in FIG. 10.14. Subsequently for the base knitted piece a knitting row is formed on the front needle bed as shown in FIG. 10.15.

After the method steps shown in FIGS. 10.0–10.15, the knitted product 80 is grown in base knitted piece 81 and in the reverse 82 by two rows, and the reverse 82 is extended by a needle. The cycle of the method steps must be repeated until the desired width of the reverse 82 is reached.

FIGS. 11.0–11.15 show a corresponding method for reducing the reverse 82. The knitting course of FIGS. 11.0–11.5 is identical to that of FIGS. 9.0–9.5. FIG. 11.6 shows how the stitches C and E of the front plane of the reverse 82 are transferred to the needles of the rear needle bed H. Thereafter the stitches of the rear plane of the reverse 82 are transferred to the needles of the front needle bed V as shown in FIG. 11.7. The rear needle bed H is then offset by two pitches to the right and the three outermost reverse stitches are transferred to the front needle bed V as shown in FIG. 11.8. Subsequently the rear needle bed H is again brought to the base position and the stitches for the rear plane of the reverse are transferred to the needles of the rear needle bed H as shown in FIGS. 11.9. In FIG. 11.10 subsequently for the reverse reduced by two needles, a1:1 stitch row is formed. Then the stitches of the rear plane of the reverse are transferred to the front needle bed V as shown in FIG. 11.11. All stitches which form the reverse are transferred from the front needle bed onto transfer elements and offset by a half pitch as shown in FIG. 11.12. Then the stitches of the base knitted piece are transferred from the associated needles of the corresponding stitch transfer elements to the needles of the rear needle bed H as shown in FIG. 11.13 and subsequently transferred to the front needle bed V as shown in FIG. 11.14, before a knitting row is formed for the base knitted piece on the front needle bed V as shown in FIG. 11.15.

After the cycle of the method steps shown in FIGS. 11.0 and 11.15, the knitted product 80 is grown in the base knitted piece 81 and in the reverse 82 by two stitch rows. Simultaneously the reverse 28 is reduced by two needles. This cycle of the method steps is repeated until the reverse 82 reaches a desired width.

The knitted products shown in FIG. 5.11 are given only as examples of the application possibilities for the inventive method. A person skilled in the art can use the inventive method to produce a plurality of various knitted products.

It will be understood that each of the elements described above, or two or more together, may also find a useful application in other types of methods and constructions differing from the types described above.

While the invention has been illustrated and described as embodied in method of producing knitted articles with several knitting planes, it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed as new and desired to be protected by letters patent is set forth in the appended claims:

What is claimed is:

1. A method of producing knitted products with several knitting planes on a two bed flat knitting machine so that all needles of one needle bed are usable for producing stitches for one stitching plane, the method comprising the following steps:

removing stitches hanging on the needles in a first knitting plane with transfer elements associated with the needles to form a further knitting plane;

offsetting the transfer elements with the stitches held on the transfer elements or an associated needle bed by a half needle pitch, whereby the transfer elements are disposed in gaps of the needle bed;

removing stitches from an opposite needle bed by needles released from the stitches, thereby forming stitches for said further knitting plane;

transferring the stitches again to the opposite needle bed;

displacing the transfer elements or the associated needle bed back by a half needle pitch, whereby the transfer elements are again located over the needles of the associated needle bed; and forming additional stitches for the first knitting plane with the needles of the needle beds.

2. A method as defined in claim 1; and further comprising transferring stitches hanging from the needles to the transfer elements by placing the stitches on needle latches or on a needle slider by needle extension movements and/or retrac tion movements and subsequently introducing the transfer elements into the stitches and withdrawing the needles from the stitches, so that the stitches alone are suspended from the transfer elements.

3. A method as defined in claim 1; and further comprising placing the stitches onto closed latches of the needles by a needle extension movement and a needle retraction movement.

4. A method as defined in claim 1; and further comprising placing the stitches by a needle extension movement on an open latch of needles.

5. A method as defined in claim 1; and further comprising, using slider needles, and placing the stitches by a needle extension movement with open sliders and a subsequent needle retraction movement h close sliders or the closed sliders.

6. A knitted product produced by the method defined in claim 1 comprising a round-ribbed knitted product.

7. A knitted product produced by the method of claim 1 comprising a round-knitted product with a knitted pocket.

8. A knitted product which is produced by a method of claim and has a base knitted piece and a reverse, wherein the reverse is produced as a parallel partial knitted piece to a base knitted piece.

* * * * *